US011826669B2

(12) United States Patent
Lo

(10) Patent No.: US 11,826,669 B2
(45) Date of Patent: Nov. 28, 2023

(54) HANDHELD BUBBLE FORMING MECHANISM

(71) Applicant: Wing Hing Manufacturing Company Limited, Hong Kong (CN)

(72) Inventor: Wai Chung Lo, Hong Kong (CN)

(73) Assignee: WING HING MANUFACTURING COMPANY LIMITED, Hong Kong (CN)

( * ) Notice: Subject to any disclaimer, the term of this patent is extended or adjusted under 35 U.S.C. 154(b) by 240 days.

(21) Appl. No.: 17/368,904

(22) Filed: Jul. 7, 2021

(65) Prior Publication Data

US 2022/0143525 A1 May 12, 2022

Related U.S. Application Data

(60) Provisional application No. 63/111,157, filed on Nov. 9, 2020.

(51) Int. Cl.
*A63H 33/28* (2006.01)
*A63H 29/22* (2006.01)

(52) U.S. Cl.
CPC ..... *A63H 33/28* (2013.01); *A63H 29/22* (2013.01)

(58) Field of Classification Search
CPC ..... A63H 33/28
USPC ..... 446/15, 16
See application file for complete search history.

(56) References Cited

U.S. PATENT DOCUMENTS 2,553,388 A * 5/1951 Steiner ..... A63H 33/28 124/37
2,599,888 A * 6/1952 Beezley ..... A63H 33/28 124/55
2,802,298 A * 8/1957 Larin ..... A63H 33/28 124/64
4,867,724 A * 9/1989 Sheng ..... A63H 33/28 446/17
4,955,840 A * 9/1990 Moomaw ..... A63H 33/28 446/17
5,462,469 A * 10/1995 Lei ..... A63H 33/28 446/15
5,498,191 A * 3/1996 DeMars ..... A63H 33/28 446/178
5,975,358 A * 11/1999 Zheng ..... F41B 9/0018 446/15
6,416,377 B1 * 7/2002 Bart ..... A63H 33/28 446/15

(Continued)

*Primary Examiner* — Joseph B Baldori
(74) *Attorney, Agent, or Firm* — Epstein Drangel LLP; Robert L. Epstein

(57) ABSTRACT

The top of a ring-like film forming member with an opening receives bubble solution and gravity causes the solution to flow over the protruding surface of a movable member within the opening such that the surface tension of the bubble solution causes a film to form within the opening and over the surface. The movable member is moved out of the way to allow wind from a wind supply to reach the rear of the ring-like member to form and release a bubble. The protruding shape of the surface allows the film to form and in intact as the member is moved. A trigger mechanically connected to the movable member controls the position of the movable member and the energization of the motor which drives the bubble solution supply and the wind supply. Continuous depression of the trigger causes a series of bubbles to be formed and released.

26 Claims, 11 Drawing Sheets

(56) References Cited

U.S. PATENT DOCUMENTS

| | | | | |
|---|---|---|---|---|
| 6,682,570 | B2 * | 1/2004 | Thai | A63H 33/28 446/15 |
| 6,820,662 | B2 * | 11/2004 | Crawford | A63H 33/28 141/366 |
| 6,860,782 | B2 * | 3/2005 | Hornsby | A63H 33/28 446/15 |
| 6,921,312 | B2 * | 7/2005 | Thai | A63H 33/28 446/176 |
| 7,056,182 | B2 * | 6/2006 | Wan | A63H 33/28 446/15 |
| 8,267,736 | B2 * | 9/2012 | Lam | A63H 33/28 446/19 |
| 8,690,630 | B2 * | 4/2014 | Lau | A63H 33/28 446/15 |
| 8,888,549 | B2 * | 11/2014 | Lo | A63H 33/28 446/16 |
| 9,050,544 | B2 * | 6/2015 | Chen | A63H 33/28 |
| 10,434,433 | B1 * | 10/2019 | Thai | A63H 33/28 |
| 10,668,399 | B2 * | 6/2020 | Weigl, Jr. | A63H 33/28 |
| 2006/0163278 | A1 * | 7/2006 | Yeung | A63H 33/28 446/15 |
| 2007/0037467 | A1 * | 2/2007 | Thai | A63H 33/28 446/15 |
| 2009/0142986 | A1 * | 6/2009 | San | A63H 33/28 446/15 |
| 2014/0141688 | A1 * | 5/2014 | Kelly | A63H 33/28 446/15 |
| 2014/0364032 | A1 * | 12/2014 | Kelly | A63H 33/28 446/15 |
| 2019/0192989 | A1 * | 6/2019 | Kelly | A63H 33/28 |
| 2022/0143525 | A1 * | 5/2022 | Lo | A63H 33/28 |

* cited by examiner

HANDHELD BUBBLE FORMING MECHANISM

CROSS-REFERENCE TO RELATED APPLICATIONS

Priority is claimed on Provisional Patent Application No. 63/111,157, filed Nov. 9, 2020, the contents of which are incorporated herein by reference.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to a handheld bubble forming mechanism and more particularly to a bubble forming mechanism in which the bubbles are created in a new and novel way.

2. Description of Prior Art Including Information Disclosed Under 37 CFR 1.97 and 1.98

Most conventional bubble making devices involve the use of a moving bar to "wipe" or a moving plane or a moving plane containing bubble rings to move against an object in order to form a bubble solution film. However, one of the major drawbacks of these designs is that the bar or the plane must be in very close proximity to the bubble rings in order to form the bubble solution film. If there exists even a small gap, which in actual production happens frequently due to tolerance or assembly issues, no bubble solution films can be formed across the bubble rings. This issue often leads to bubble making devices being deemed to be defective as no bubbles can be produced.

Accordingly, there is a need for a bubble forming mechanism which reliably forms bubbles without the use of a moving bar or a moving object to move against the bubble rings to form a bubble film.

BRIEF SUMMARY OF THE INVENTION

The disadvantages of the conventional bubble forming devices are overcome by the present invention by using a fixed ring-like film forming member with an opening and a second, movable member with a protruding surface the approximate size of the opening. With the movable member proximate the fixed member opening, bubble solution transferred to the top of the fixed member is caused by gravity to flow into the opening and the surface tension of the bubble solution forms a bubble solution film within the opening and over the aperture member surface. The movable member surface is withdrawn from the film within the opening such that wind from a wind supply causes the film to form and release a bubble. The movable member can be repeatedly "stamped" into the bubble liquid film inside the opening, causing bubbles to be formed with a much higher success rate as compared to conventional bubble film making devices.

The mechanism also includes a motor and a trigger connected to the motor which when depressed a first time causes bubble solution from a container to be transferred to the top of the film forming member. The motor also drives the wind supply in response to pulling the trigger a first time. Once the motor is actuated, bubble solution will continue to be transferred to the film forming member and the wind supply will continue to provide a stream of air to the film to the film forming member until the trigger is released.

In response to releasing the trigger and depressing the trigger a second time, the movable aperture member is moved to a position remote from the film forming member, withdrawing the movable member surface from the film within the film forming member opening, allowing the air from the wind supply to cause a bubble to be formed and released.

Repeated depression of the trigger will cause bubbles to be formed and released. Continuous depression of the trigger will cause a series of bubbles to be rapidly forming and released.

In accordance with one aspect of the present invention a bubble forming mechanism is provided including a first member defining an opening and a second member having a protruding surface approximately the size of the first member opening. The first member and the second are movable relative to each other between a first position in which the first member and the second member are proximate each other such that the second member surface is within the first member opening and a second position in which the first member and the second member are remote from each other.

A bubble solution supply is connected to supply bubble solution to the top of the first member when activated. A wind supply provides wind to the first member when activated. A spring-loaded actuator is provided. When the actuator is depressed the bubble solution supply is activated to supply bubble solution to the first member and the wind supply is activated to provide wind to the first member. Releasing the trigger deactivates the bubble solution supply and the wind supply.

With the members in the proximate position, the actuator is depressed a first time to activate the bubble solution supply and the wind supply and move the members to the remote position. The actuator is released to deactivate the solution supply and the wind supply and move the members to the proximate position. The actuator is depressed a second time to activate the wind supply and the bubble solution supply to supply bubble solution to the first member, such that gravity causes the bubble solution to form a film within the first member opening and over the first member surface, and to move the members to the remote position, wherein wind from the wind supply causes the film to form a bubble.

The first member preferably has a ring-like configuration. The first member includes a channel with a wall at least partially surrounding the first member opening. The channel is connected to the bubble solution supply to receive the bubble solution. The channel wall has at least two and preferably a plurality of spaced protrusions between which solution from the channel flows into the first member opening to form the film.

The second member surface has a shape of least one of the following: conical, hemispherical, arcuate, pointed and any combination thereof.

Continuous depression of the actuator activates the bubble solution supply and the wind supply causing a series of bubbles to be formed.

The actuator takes the form of a trigger which can be depressed from an original extended position to an activation retracted position and returns automatically to the original position when released.

When the first member and second member are moved to the remote position, wind from the wind supply can move around the second member to the first member or the second member is rotated away from the first member such that wind from the wind supply can move to the first member.

In accordance with another aspect of the present invention, a bubble forming mechanism is provided including a film forming member defining an opening and having a top and a second member having a protruding surface approximately the size of the film forming member opening. The film forming member and the second member are movable relative to each other between an initial position in which the film forming member and the second member are proximate each other such that the second member surface is within the film forming member opening and a position in which the film forming member and the second member are remote from each other.

A bubble solution supply is connected to supply bubble solution to the top of the first member when activated. A wind supply provides wind to the film forming member when activated.

A spring-loaded trigger is provided which when depressed activates the bubble solution supply to supply bubble solution to the top of the film forming member and activates the wind supply to provide wind to the film forming member. When released the trigger deactivates the bubble solution supply and the wind supply.

With the members in the proximate position, the trigger is depressed a first time to activate the bubble solution supply and the wind supply and move the members to the remote position. The trigger is released to deactivate the solution supply and the wind supply and move the members to the proximate position.

The trigger is depressed a second time to activate the wind supply and activate the bubble solution supply to supply bubble solution to the top of the film forming member such that gravity causes the bubble solution from the top of the film forming member to form a film within the film forming member opening and over the film forming member surface, and move the members to the remote position, wherein wind from the wind supply causes the film to form a bubble.

The film forming member preferably has a ring-like configuration. The film forming member has a channel with a wall at least partially surrounding the film forming member opening. The channel is connected to the bubble solution supply to receive the bubble solution. The channel wall has at least two and preferably a plurality of spaced protrusions between which solution from the channel flows into the film forming member opening to form the film.

The second member surface has a shape of least one of the following: conical, hemispherical, arcuate, pointed and any combination thereof.

Continuous depression of the trigger activates the bubble solution supply and the wind supply causing a series of bubbles to be formed.

The trigger can be depressed from an original position to an activation position and automatically returns to the original position when released because the trigger is spring-loaded.

When the film forming member and second member are moved to the remote position, the second member is either moved away from the film forming member such that wind from the wind supply can move around the second member to the film forming member or is rotated away from the film forming member such that wind from the wind supply can move to the film forming member.

In accordance with another aspect of the present invention a bubble forming mechanism is provided including a ring-like member defining an opening and having a top and a second member having a protruding surface approximately the size of the ring-like member opening. The second member is movable relative to the ring-like member between an initial position in which the ring-like member and the second member are proximate each other such that the second member surface is within the ring-like member opening, and a position in which the ring-like member and the second member are remote from each other.

A motor is provided. The bubble solution supply is connected to supply bubble solution to the top of the ring-like member when the motor is activated. A wind supply is provided for supplying wind to the ring-like member when the motor is activated.

A spring-loaded trigger controls the motor and when depressed activates the motor to cause the bubble solution supply to supply bubble solution to the top of the ring-like member and activates the motor to cause the wind supply to provide wind to the ring-like member. When released, the trigger deactivates the motor.

With the second member in the initial position, the trigger is depressed a first time to activate the motor to cause the bubble solution supply to supply bubble solution to the ring-like member and to cause the wind supply to supply wind to the ring-like member, and to move the second member to the remote position.

The trigger is released to deactivate the motor and move the second member to the initial position. The trigger is depressed a second time to activate the motor to cause the wind supply to provide wind to the ring-like member and activate the motor to cause the bubble solution supply to supply bubble solution to the top of the ring-like forming member such that gravity causes the bubble solution from the top of the ring-like member to form a film within the ring-like member opening and over the ring-like member surface, and to move the second member to the remote position, wherein wind from the wind supply causes the film to form a bubble.

The mechanism also includes a battery and a switch connected to the trigger. The switch connects the motor to the battery in response to the trigger being depressed.

The wind supply includes a motor connected to drive a propeller. The propeller is situated in an enclosure.

Continuous depression of the trigger activates the motor to cause the bubble solution supply to supply bubble solution to the ring-like member and to causes the wind supply to supply wind to the ring-like member such that a series of bubbles is formed.

When the second member is moved to the remote position, wind from the wind supply can either move around the second member to the ring-like member or is rotated away from the ring-like member such that wind from the wind supply can move to the ring-like member.

In accordance with another aspect of the present invention, a film forming member is provided for use in a bubble forming mechanism including a member at least partially defining an opening and a channel adapted to receive bubble solution. The channel has at least two spaced protrusions between which bubble solution from the channel flows into the opening to form the bubble solution film.

Preferably, the channel has a plurality of spaced protrusions between which bubble solution from the channel flows into the opening to form the bubble solution film.

The channel has inner and outer spaced channel walls. The protrusions are associated with the inner channel wall.

BRIEF DESCRIPTION OF THE SEVERAL VIEWS OF DRAWINGS

To these and to such other objects that may hereinafter appear, the present invention relates to a handheld bubble forming mechanism as described in detail in the following specification and recited in the annexed claims, taken together with the accompanying drawings in which:

Figure 5A:
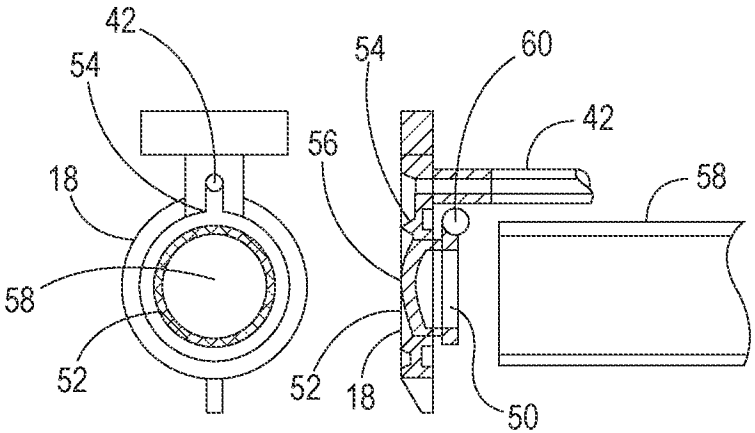
Figure 5B:
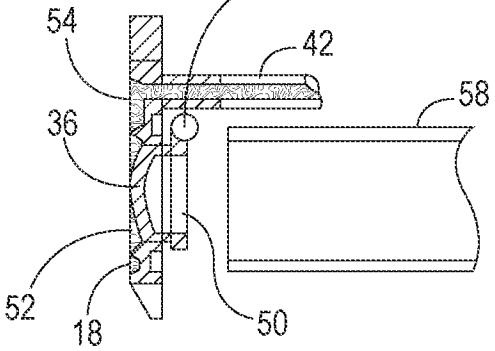
Figure 5C:
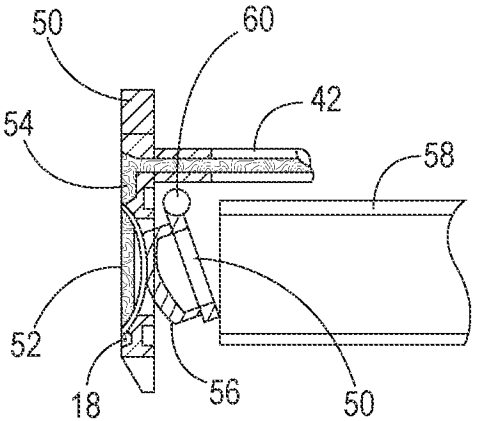
Figure 5D:
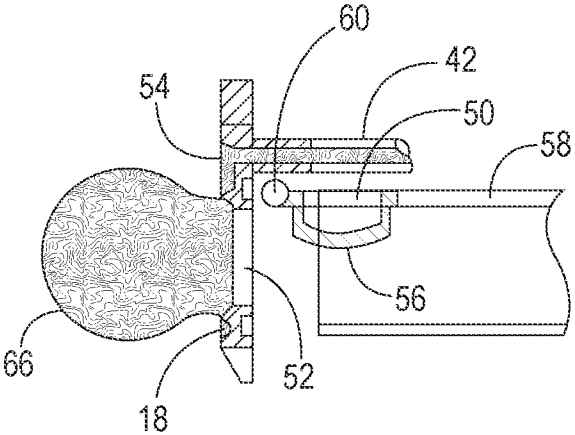
Figure 6:
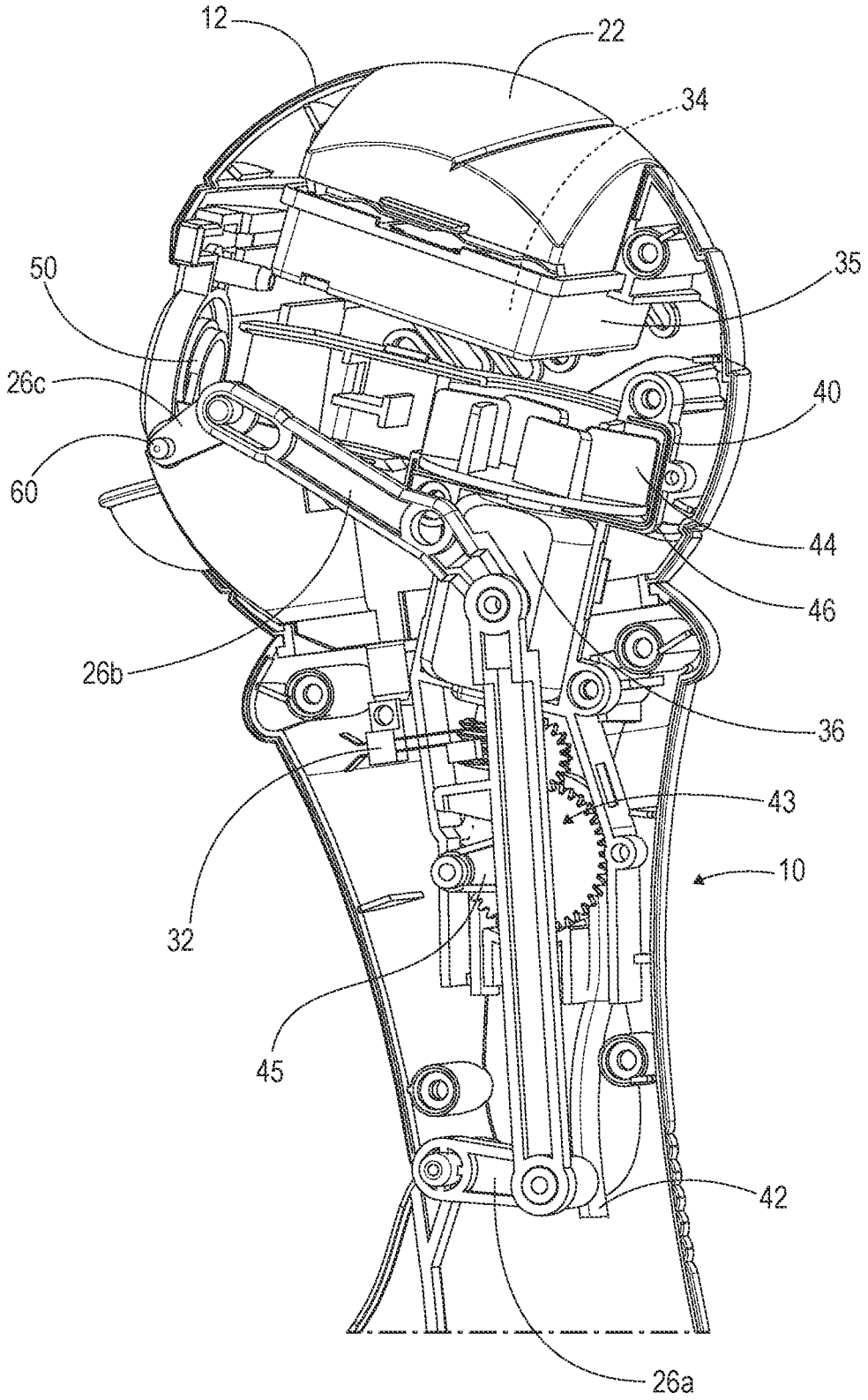
Figure 7:
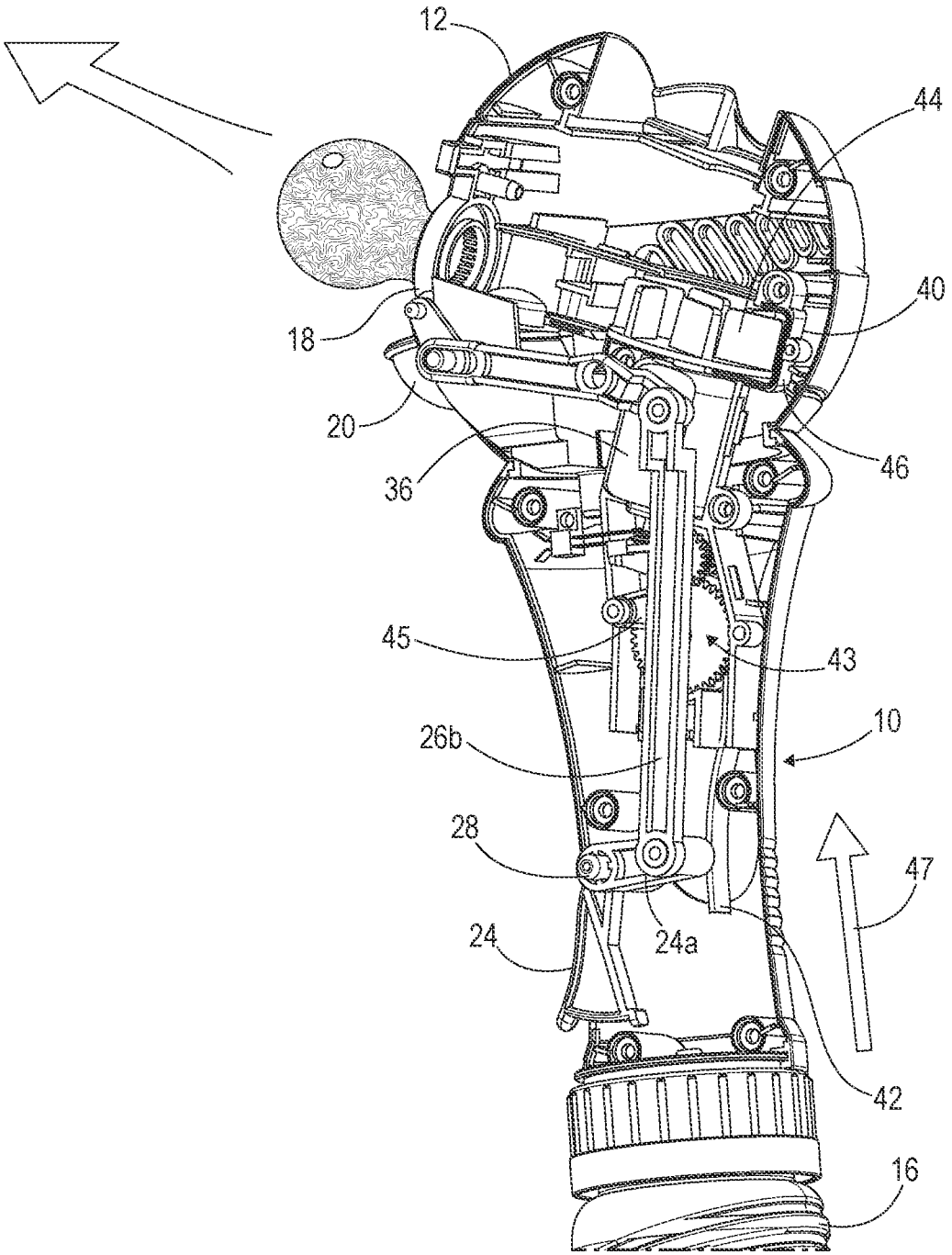
Figure 8A:
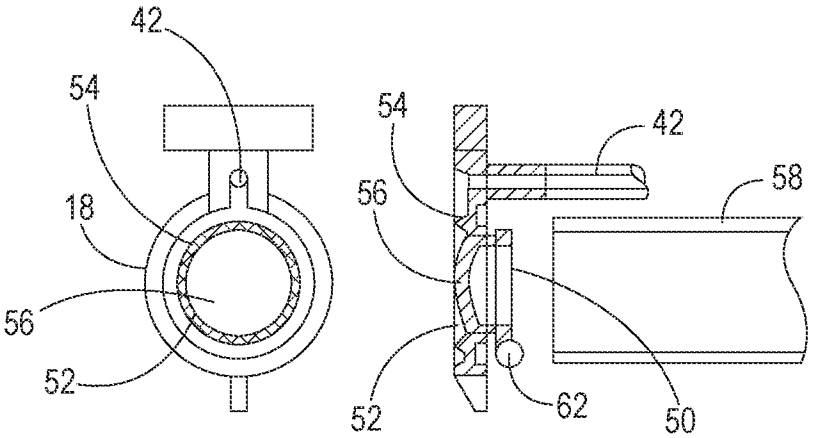
Figure 8B:
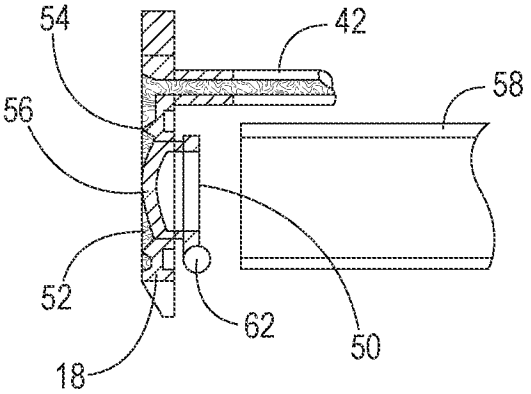
Figure 8C:
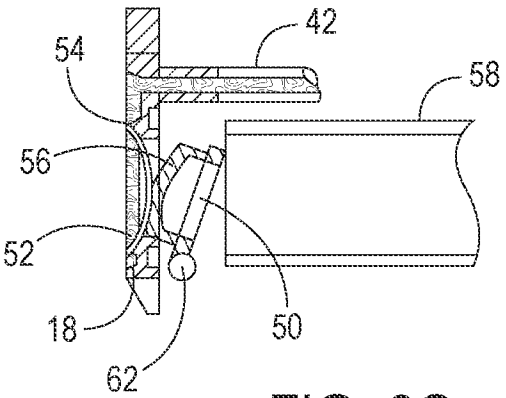
Figure 8D:
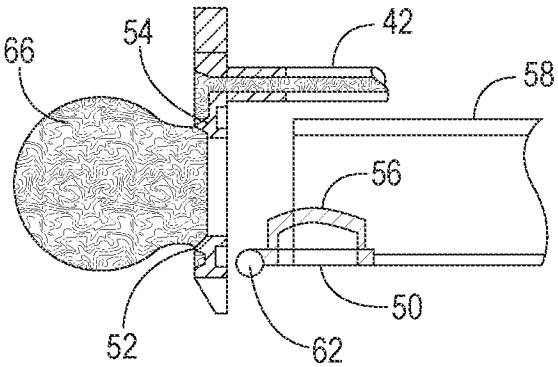
Figure 9B:
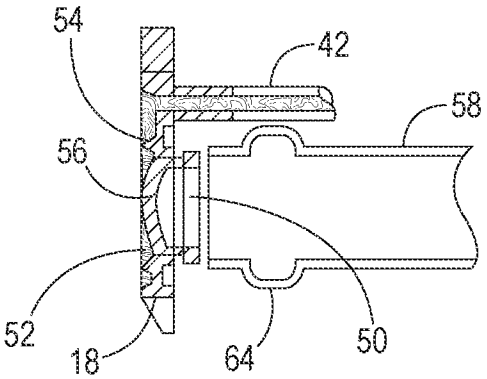
Figure 9D:
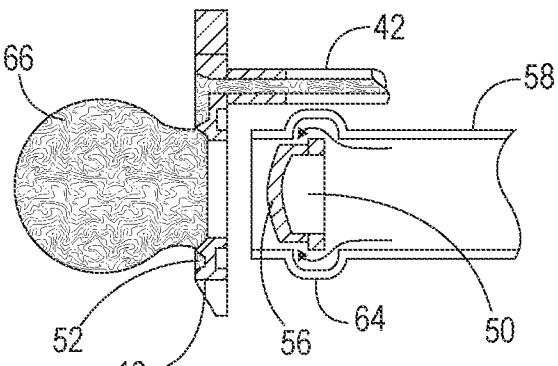
Figure 9A:
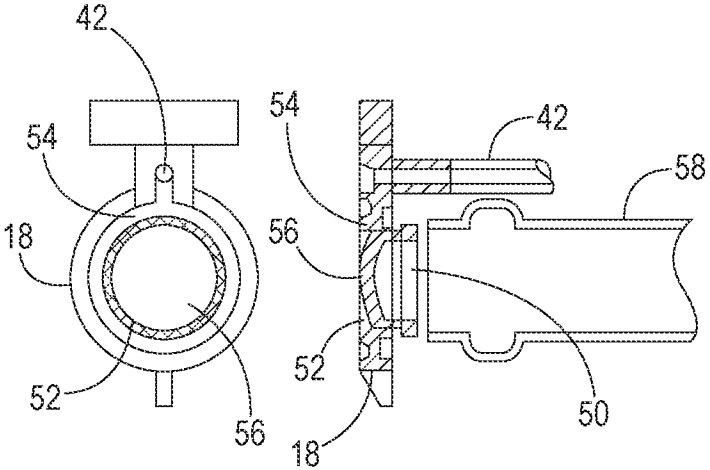
Figure 9C:
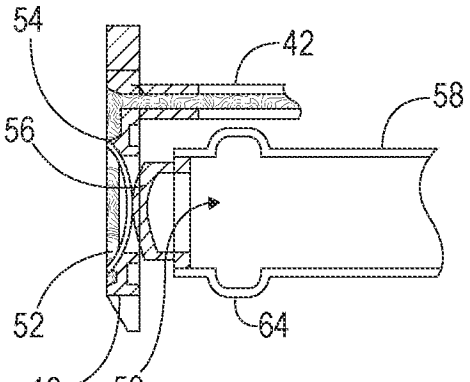
Figure 10A:
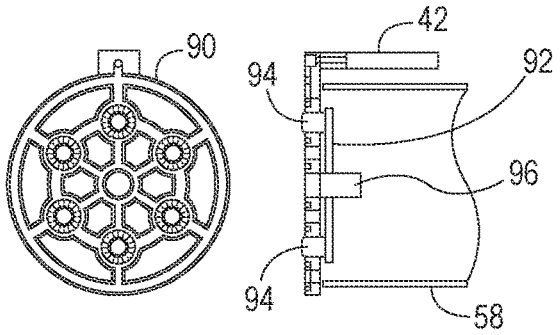
Figure 10B:
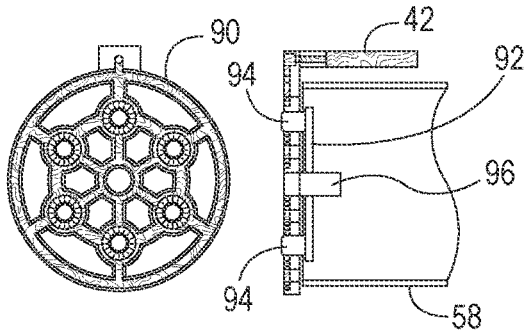
Figure 10C:
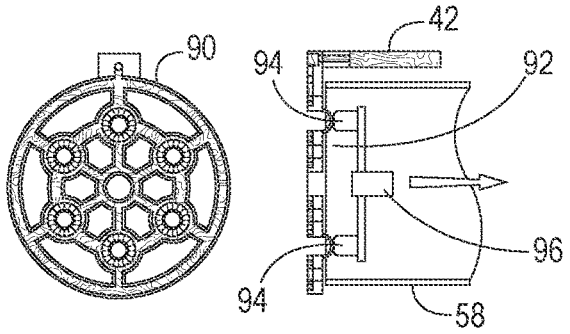
Figure 10D:
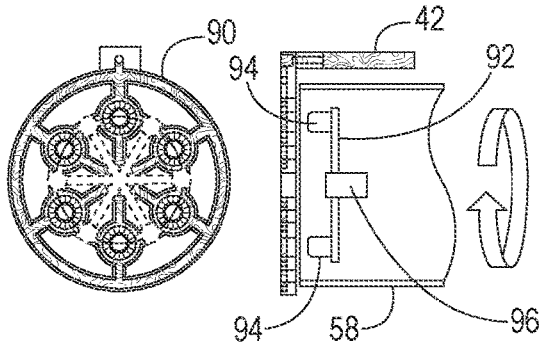
Figure 10E:
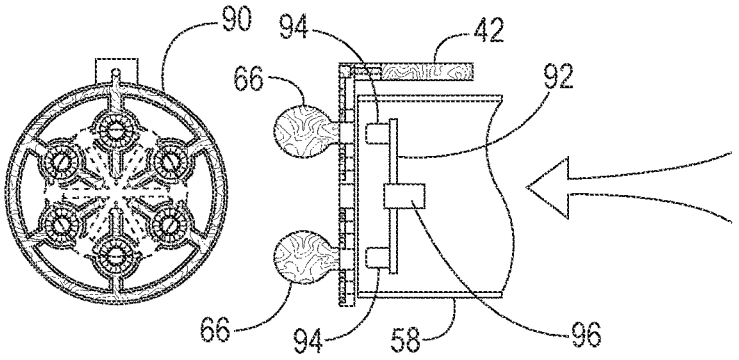
Figure 11A:
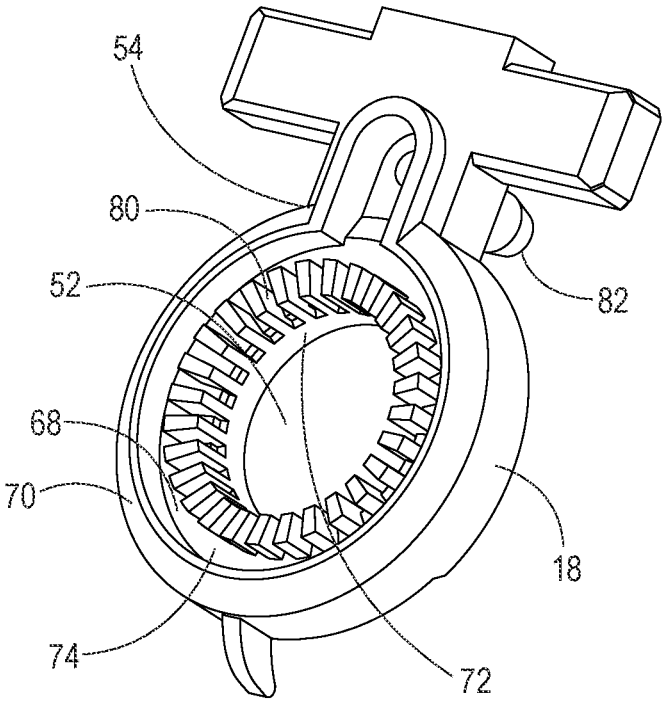
Figure 11B:
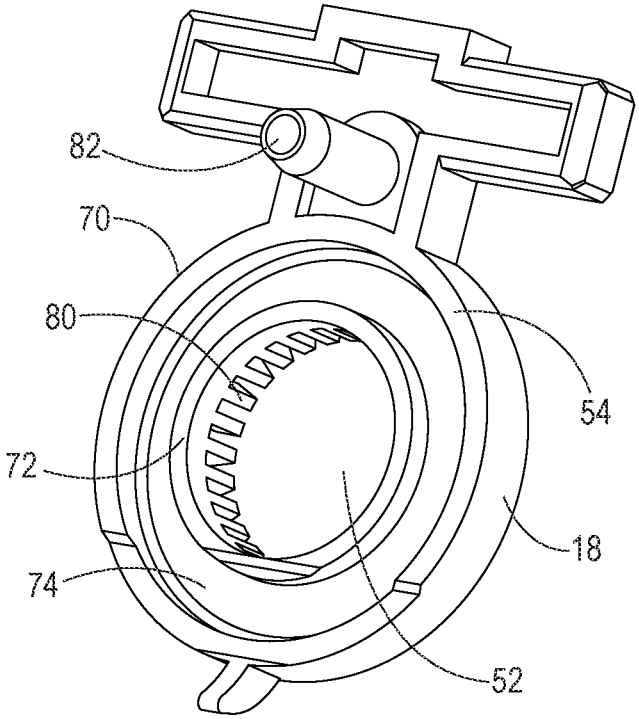

FIGS. 5A-5D illustrate the movement of the movable member in a first preferred embodiment of the mechanism in which FIG. 5A includes an elevation view of the film forming member and a cross-sectional view of the movable member in the initial position, before bubble solution is supplied; FIG. 5B shows a cross-sectional view of the movable member as the bubble solution is being supplied, FIG. 5C shows a cross-sectional view of the movable member as it is rotated upward away from the ring-like member; and FIG. 5D showing a cross-sectional view of the movable member in the final position wherein wind from the wind supply conduit is supplied to the rear of the ring-like member to create a bubble;

FIG. 6 is an internal view showing the components before the trigger is depressed the second time;

FIG. 7 is an interval view showing the components after the trigger has been depressed the second time;

FIGS. 8A-8D illustrate the movement of the movable member in a second preferred embodiment of the mechanism in which FIG. 8A includes an elevation view of the film forming member and a cross-sectional view of the movable member in the initial position, before bubble solution is supplied; FIG. 8B shows a cross-sectional view of the movable member as the bubble solution is being supplied, FIG. 8C shows a cross-sectional view of the movable member as it is rotated downward away from the film forming member; and FIG. 8D shows a cross-sectional view of the movable member in the final position wherein wind from the wind supply conduit is supplied to the rear of the film forming member create a bubble;

FIGS. 9A-9D illustrate the movement of the movable member in a third preferred embodiment of the mechanism in which FIG. 9A includes an elevation view of the film forming member and a cross-sectional view of the movable member in the initial position, before bubble solution is supplied; FIG. 9B shows a cross-sectional view of the movable member as the bubble solution is being supplied; FIG. 9C shows a cross-sectional view of the movable member as it moves away from the film forming member into an enlarged portion of the wind supply conduit; and FIG. 9D shows a cross-sectional view of the movable member in the final position wherein wind from the wind supply conduit as wind is supplied to the rear of the film forming member to create a bubble;

FIGS. 10A-10E each include a elevation view of a multiple opening film forming member and a cross-section view of the multiple surface movable member in another preferred embodiment of the bubble forming mechanism wherein FIG. 10A shows the members in the initial positions, before bubble solution is supplied; FIG. 10B shows bubble solution being supplied to the multiple opening film forming member; FIG. 10C shows the platform with the multiple movable members moving away from the film forming member; FIG. 10D shows the platform being rotated; and FIG. 10E shows wind being supplied to the rear of the film forming member to form more than one bubble at a time; and FIGS. 11*a* and 11B illustrate in greater detail the structure of the film forming member as viewed in front perspective (FIG. 11A) and rear perspective (FIG. 11B).

DETAILED DESCRIPTION OF THE INVENTION

Figure 1A:
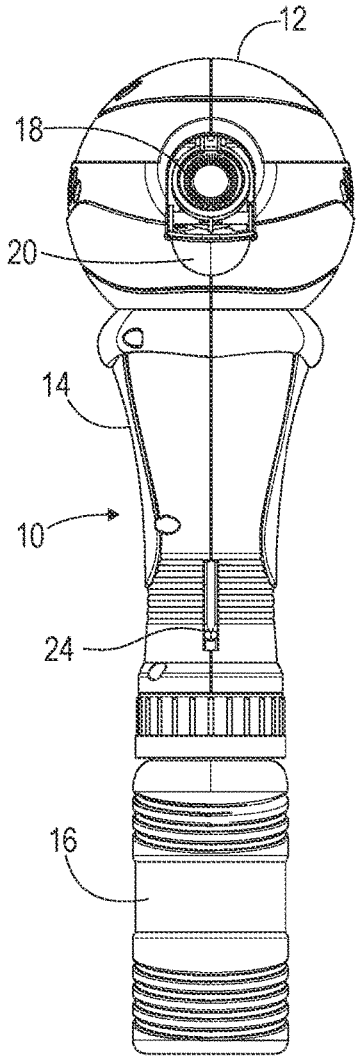
FIG. 1 shows the exterior of the bubble forming mechanism as seen from the front (FIG. 1A), the side (FIG. 1B) and partially rotated such that a portion of the front and a portion of the side are visible (FIG. 1C), respectively.
Figure 1B:
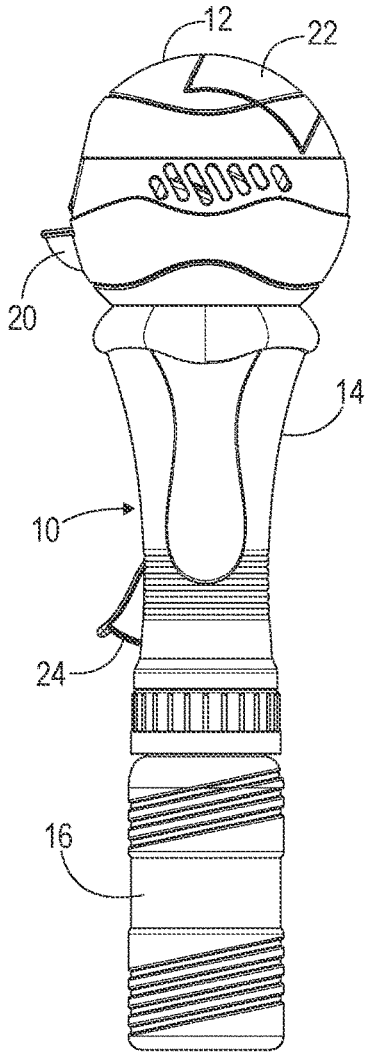
Figure 1C:
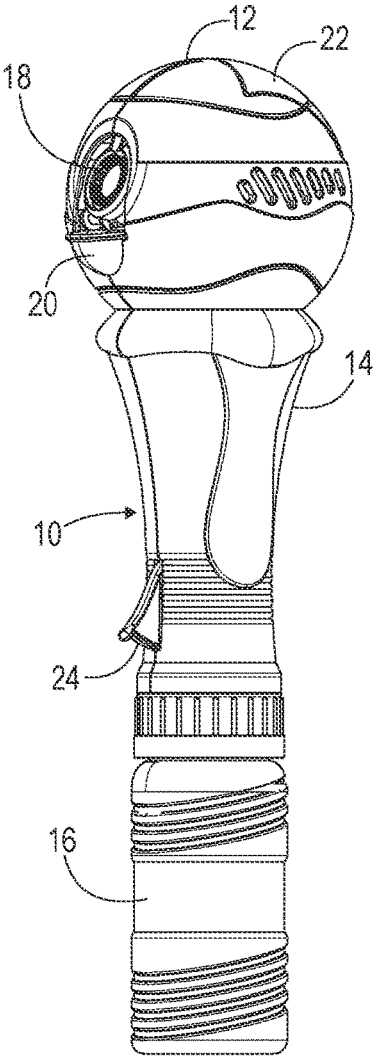

FIG. 1A, FIG. 1B and FIG. 1C show the exterior housing or shell 10 of the handheld bubble forming mechanism respectively from the front, side and rotated such that part of the front and part of the side are visible. Shell 10 may be made of plastic and includes a substantially spherical top portion 12, a handle portion 14 and a bubble solution container 16.

Figure 2:
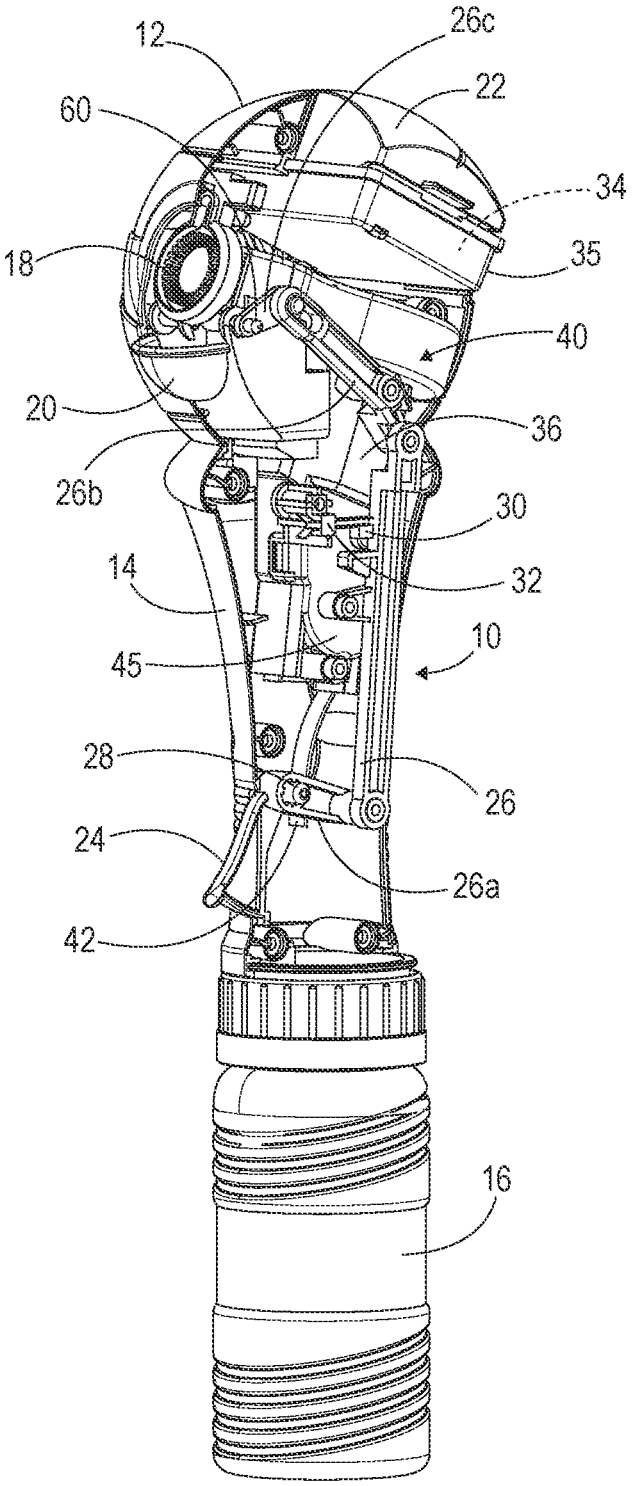
FIG. 2 is an internal view of the bubble forming mechanism in the initial position showing the various components thereof including the wind supply enclosure.
Figure 3:
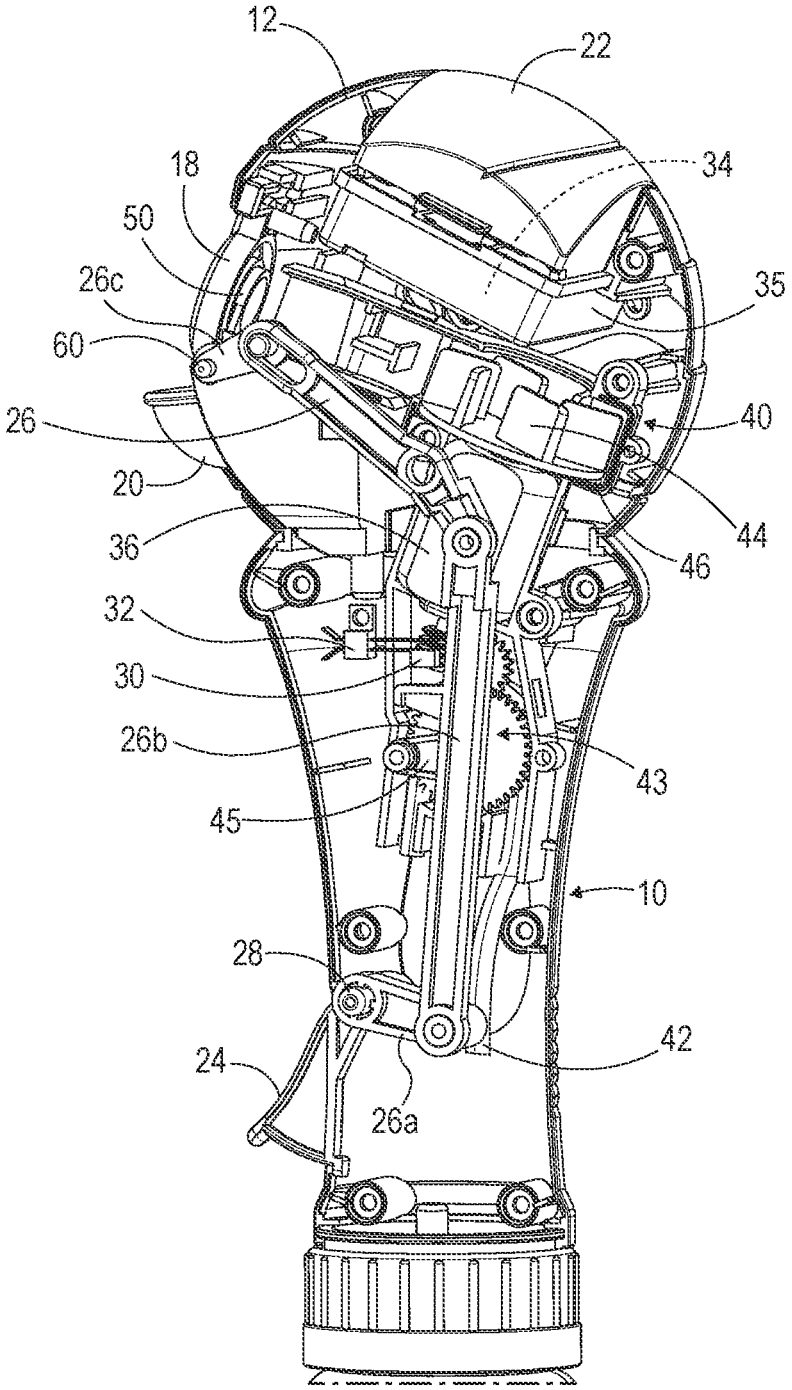
FIG. 3 is an internal view of the bubble forming mechanism in the initial position showing the motor output shaft, the gears driven by the motor to supply bubble solution and the impeller of the wind supply.

As seen in FIGS. 2 and 3, spherical top portion 12 of shell 10 houses a compartment which holds one or more batteries accessed through a removable shell section 22 at the top portion of the shell. Top portion 12 also contains the parts which form the bubbles, including a film forming member 18 and a device which supplies wind to member 18. Below member 18 is a beak-shaped drain 20 which catches bubble solution overflow from member 18 and via an internal tube (not shown) returns same to the bubble solution container 16.

The handle portion 14 of the shell includes a spring-loaded trigger 24 which can be depressed from its extended position to control bubble production. When released, trigger 24 automatically returns to its extended position.

The bubble solution container 16 may take the form of a plastic bottle with an externally threaded neck. The bottle neck is received within a recess in the bottom of the handle and is connected to supply bubble solution to the film forming member 18 when the trigger is depressed.

Trigger 24 is mechanically connected to the parts which form the bubbles located in top portion 12 by a control rod 26. The trigger is also connected to activate the wind supply and the bubble solution supply when the trigger is depressed.

Rod 26 has a bottom section 26A, a main section 26B and a top section 26C which are connected to the internal surface of the shell in a manner which transfers the depression of the trigger to control the movement of the bubble forming parts, the activation of the bubble solution supply and the activation of the wind supply.

Trigger 24 rotates about a shaft 28 protruding from a recess in the shell wall when depressed. Section 26A is also connected to and rotates with the trigger such that depressing the trigger causes section 26A to rotate around shaft 28 in a counterclockwise direction in turn causing rod 26 to move toward the top of the device.

Section 26B of the control rod has a part 30 which extends from the side of the rod. Part 30 is situated to engage the contacts of a switch 32 when rod 26 is moved toward the top of the shell cause the contacts of switch 32 to close. Closing the switch contacts causes switch 32 to connect one or more batteries 34, located in a compartment 35 within top portion 12 of shell 10, with a motor 36.

Motor 36 is connected to drive both the bubble solution supply 38 and the wind supply 40 when activated by depressing trigger 24. The bubble solution supply includes a flexible bubble solution supply tube 42 and a series of gears, generally designated 43, abutting the supply tube 42. One end of supply tube 42 is situated within the bubble solution container 16.

Rod 26 has a part 45 which moves with the rod and is attached to drive the gears 43 to alternately apply pressure to compress the adjacent section of the supply tube 42 and release the pressure when the gears are rotated by motor 36 to siphon bubble solution from container 16 to the film forming parts in the top portion 12 of the shell.

Motor 36 is also connected to drive the wind supply 40. The wind supply 40 is located in the top portion of the shell below the battery 34 and includes an impeller 44 within a casing 46. When activated, motor 36 causes impeller 44 to rapidly rotate within casing 46 to provide wind to the film forming parts through a wind supply conduit 58, as described in greater detail below.

The bubble forming parts in the top portion of the shell include film forming member 18, which is attached to the front of the shell and a member 50 which is moved relative to member 18 by control rod 26. Member 50 is movable relative to member 18 between the initial position, in which member 50 is proximate to member 18, and a remote position, in which member 50 is remote from member 18.

Member 18 has a ring-like configuration defining an opening 52. The top portion 54 of member 18 is situated over opening 52. Member 50 has a protruding surface 56 approximately the same size and shape of opening 52 in member 18. The protruding shape of surface 56 allows member 50 to easily "detach" from the bubble solution film being formed within opening 52 while not breaking the bubble solution film. Surface 54 is preferably conical, hemispherical, arcuate, pointed or any combination thereof.

In the initial position in which members 18 and 50 are proximate each other, surface 56 is situated within opening 52 in member 18. In the remote position of the members, surface 56 is spaced from member 18.

Bubble solution supply tube 42 is connected to supply bubble solution to the top portion 54 of member 18 when motor 36 is activated, as explained above. Wind supply 40 provides wind to back of member 18 through a wind supply conduit 58 when the motor is activated.

When trigger 24 is depressed, motor 36 causes bubble solution to be supplied to the top portion of member 18 and wind is supplied to member 18. When the trigger is released, the motor is turned off.

Figure 4:
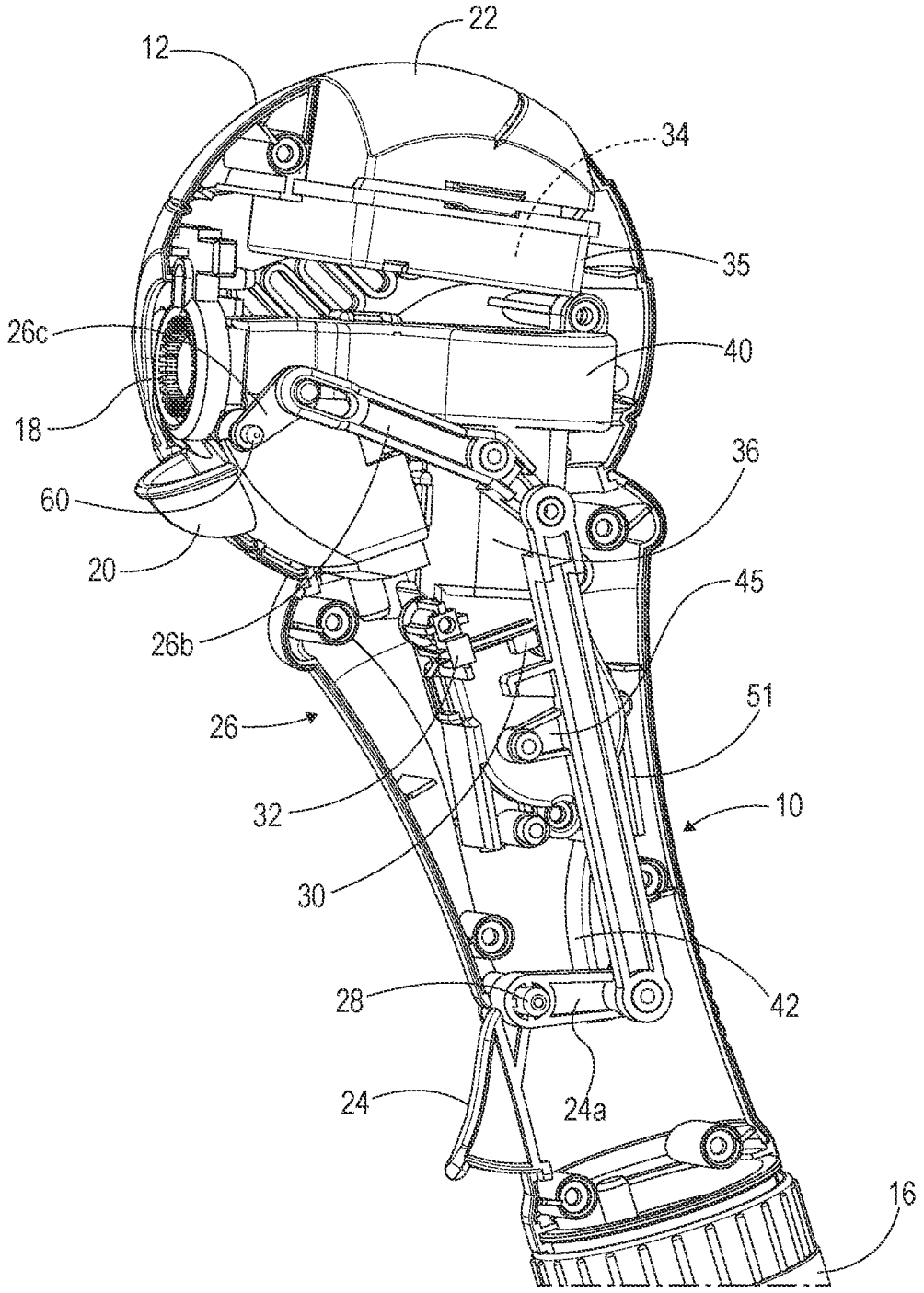
FIG. 4 is an internal view showing the components before the trigger is depressed the first time.

FIG. 4 shows the internal components before trigger 24 is depressed the first time, with member 50 in the initial position proximate member 18. When the trigger is depressed a first time the motor is activated to cause the bubble solution supply to supply bubble solution to the top of member 18, to cause the wind supply to supply wind to member 18, and to move member 50 to the remote position, away from member 18.

When the trigger is released, the motor is turned off. Member 50 is automatically returned to the proximate position as control rod 26 is moved back to its original position by a spring 51 extending between the control rod and the shell.

FIG. 6 shows the internal components before trigger 24 is depressed the second time. As the trigger is depressed the second time, the motor activates the wind supply to provide wind to member 18 and activates bubble solution supply to supply bubble solution to the top portion 54 of member 18. Gravity then causes the bubble solution from the top of member 18 to flow into opening 52 such that the surface tension of the bubble solution forms a film within the opening and over surface 56 of member 50. Member 50 is the withdrawn from opening 52 by movement of control rod 26 as depicted by arrow 47 in FIG. 7 and moved to the remote position. In that position of member 50, wind from the wind supply can reach member 18 and cause the film in opening 52 to form and release a bubble 66, as indicated by arrow 49 in FIG. 7.

FIGS. 5A-5D, 8A-8D and 9A-9D respectively illustrate three preferred embodiments of the mechanism which moves member 50 to its remote location relative to member 18. In FIGS. 5A-5D and in FIGS. 8A-8D, member 50 is rotated about the axis of a shaft 60 by the movement of rod 26. In FIGS. 9A-9D, member 50 is moved away from member 18 in a direction generally perpendicular to the plane of member 18 by rod 26. In all embodiments, member 50 is moved to a position which allows wind from wind conduit 58 to reach the rear of member 18 such that the film previously formed within opening 52 creates the bubble.

More specifically, FIGS. 5A, 8A and 9A each show an elevation view of the front of member 18, a cross-sectional view of member 18 and a cross-sectional view of member 50 in its initial or proximate position. In that position, surface 56 is within opening 52 of member 18. Also shown is bubble solution supply tube 42 in cross-section and the wind supply conduit 58 in cross-section.

In FIGS. 5A and 8A, member 50 is rotated around shaft 60 (FIG. 8A labeled 62 for the shaft) which extends from the interior of the shell near the top of the device. Shaft 60 is attached to rod section 26C such that member 50 is moved to the remote position as control rod 26 is moved upward by depression of trigger 24. In FIG. 9A, member 50 moved laterally away from member 18, as described below. Those figures also show the bubble solution supply tube 42, prior to bubble solution being provided to member 18, and the wind supply conduit 58.

FIGS. 5B, 8B and 9B show bubble solution being supplied to the top 54 of member 18 through bubble solution supply tube 42.

FIGS. 5C, 8C and 9C show member 50 as it is being moved to the remote position. In FIG. 5C, member 50 is rotated around shaft 60 at the top of the member as noted. In FIG. 8C, member 50 is rotated around a shaft 62, which is located at the bottom of the member. Shaft 62 serves the same purpose as shaft 62 and is also attached to rod section 26C, which in this case would be elongated to accommodate the different location of the shaft. In FIG. 9C, when the trigger is depressed, the control rod is directly connected to the control rod such that member 50 is moved away from member 18 in a direction generally perpendicular to the plane of member 18, toward a circumferentially expanded section 64 of wind supply conduit 58.

FIGS. 5D, 8D and 9D show member 50 in its final remote position. In FIG. 5D, member 50 is situated at the top of wind supply conduit 58 such that wind from the wind supply can move under member 50 to member 18 to create bubble 66. In FIG. 8D, member 50 is situated at the bottom of wind supply conduit 58 such that wind from the wind supply can move over member 50 to member 18 to create bubble 66. In FIG. 9D, member 50 is moved away from member 18 in a direction generally perpendicular to the plane of member 18 to section 64 which has a diameter larger than that of member 50 such that wind from the wind supply can move around member 50 to opening 52 in member 18 to create the bubble.

FIGS. 11A and 11B are respectively front and rear perspective views of member 18, showing the member in greater detail. Member 18 includes a circular channel 68 which at least partially surrounds opening 52. The channel is formed an outer wall 70, an inner wall 72 spaced from outer wall 70 and a wall 74 connecting the inner and outer walls. Inner wall 72 defines opening 52.

A portion of wall 72 consists of a plurality of spaced protrusions or "spikes" 80. Bubble solution is supplied to member 18 through port 82 which is connected to the bubble solution supply tube 42. Port 82 is connected to channel 68 such that bubble solution from port 82 flows into the channel near the top 54 of member 18. Once the bubble solution enters the channel, gravity causes the bubble solution to fill the channel and flow between protrusions 80 into opening 52 in member 18.

When member 50 is in position proximate member 18, surface 56 is within opening 52. The surface tension of the flowing bubble solution forms a film within the opening and over surface 56. Withdrawing member 50 to a position remote from member 18 allows wind from the wind supply conduit 58 reach member 18 from behind and create the bubble 66 from the film.

Depression of the trigger activates the bubble solution supply and the wind supply causing a series of bubbles to be formed. Each time the trigger is depressed after the first time, the film is formed and member 50 is moved to the remote position allowing wind to form a bubble. Continuous depression of the trigger will cause a series of bubbles to be formed and released. Since the motor and the gear system will continuously siphon the bubble solution from the bubble container to the top portion of member 18 and provide a constant supply of bubble solution, bubbles are continuously be formed until the trigger is released.

As illustrated in FIGS. 10A-10E, it is possible to modify the bubble forming mechanism to form and release more than one bubble at a time. Each FIG. 10A-10E includes elevation view of the front a multiple opening film forming member 90 and a cross-sectional view of the movable member which in this case takes the form of a rotating platform 92 having multiple members 94 with protruding surfaces, similar to those of member 50.

FIG. 10A shows the members in the initial position before the bubble solution is supplied to member 90. FIG. 10B shows the members as bubble solution from bubble solution supply tube 42 is supplied to the top of member 90 and film is formed within the opening in member 90 and over the members 94 situated in the openings. FIG. 10C shows platform 92 with members 94 being moved to the position remote from member 90. FIG. 10D shows platform 92 rotated about a central axis 96. FIG. 10E shows that wind from wind supply conduit 58 causes more than one bubble to be formed and released.

In one preferred embodiment, once the bubble solution film is formed on the multi-opening member, the platform is rotated approximately 30 degrees thus allowing the wind created by the wind supply behind member 90 to blow air thru the openings. Subsequently, the platform will be rotated back for the same 30 degree and members 94 to be inserted within the openings in member 90 again and another series of bubble solution films will be formed. With this continued in a back and forth manner, large amounts of bubbles can be formed.

As noted in the above, most of the conventional bubble making devices involve a moving bar to "wipe" or a moving plane or a moving plane containing bubble rings to move against an object in order to form a bubble film. One of the major drawbacks of these designs is that the bar or the plane must be in very close proximity to the bubble rings in order to form the bubble film. If there exists a small gap, which in actual production may happen due to tolerance or assembly issues, no bubble films can be formed across the bubble rings. This issue often leads to bubble making devices being deemed to be defective as no bubbles can be produced.

With the novel film forming member and movable member with the protruding surface of the present invention, neither a moving bar nor a moving object is needed to move against the bubble rings to form a bubble film. Instead, the protruding surface of the movable member is being "stamped" into the bubble solution film within the opening and thus the bubble solution film can be formed with a much higher success rate as opposed to the existing bubble film making devices.

The protruding surface of the movable member also allows the member to be detached more easily from the film, reducing the chance of breaking the film being formed. As described above, there are several ways of moving the movable member while keeping the film intact.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

I claim:

1. A bubble forming mechanism comprising a shell, said shell defining an internal space, a member fixed to said shell having an opening and a top; a moveable member situated within said internal space of said shell comprising a surface sized to be received within said fixed member opening; said movable member being movable within said internal space of said shell relative to said fixed member between a position in which said movable member is remote from said fixed member and a position wherein said moveable member is proximate said fixed member and said movable member surface is within said fixed member opening, a bubble solution supply connected to supply bubble solution to said top of said fixed member such that gravity causes the bubble solution to form a film within said fixed member opening and over said moveable member surface, when said movable member is in said proximate position; a wind supply providing wind to said fixed member after said film is formed and said movable member is moved to said remote position, causing a bubble to be formed; and an actuator for controlling said position of said moveable member, for activating said bubble solution supply and for activating said wind supply.

2. The mechanism of claim 1 wherein said movable member surface comprises a protruding portion.

3. The mechanism of claim 1 wherein said shell has a front and fixed member is situated in said front of said shell.

4. The mechanism of claim 1 wherein said movable member surface faces the exterior of said shell when said movable member is in said proximate position.

5. The mechanism of claim 1 wherein said shell comprises a top portion.

6. The mechanism of claim 5 wherein at least a portion of said internal space is within said top portion of said shell.

7. The mechanism of claim 5 wherein said wind supply is situated within said top portion of said shell.

8. The mechanism of claim 1 wherein said shell comprises a handle portion.

9. The mechanism of claim 8 wherein at least a portion of said bubble solution supply is located in said handle portion of said shell.

10. The mechanism of claim 8 wherein said actuator comprises a spring-loaded trigger located on said handle portion of said shell.

11. The mechanism of claim 10 wherein a first depression of said trigger causes said movable member to move to said proximate position and actuates said bubble solution supply, and a second depression of said trigger moves said movable member to said remote position and actuates said wind supply.

12. The mechanism of claim 1, wherein said shell comprises a handle portion and said actuator comprises a depressible actuator associated with said handle portion.

13. The mechanism of claim 12 wherein, with said movable member in said proximate position, depression of said actuator activates said bubble solution supply.

14. The mechanism of claim 13, wherein, with said movable member in said remote position, continued depression of said actuator actuates said wind supply and causes the formation of a continuous series of bubbles.

15. The mechanism of claim 1 wherein said movable member surface has a shape of at least one of the following: conical, hemispherical, arcuate, pointed and any combination thereof.

16. The mechanism of claim 1 wherein, when said movable member is moved to said remote position, wind from said wind supply can move around said movable member to said fixed member.

17. The mechanism of claim 1 wherein, when said movable member is rotated away from said fixed member, wind from said wind supply can move to said fixed member.

18. The mechanism of claim 1 wherein said movable member is pivotally connected to rotate away from said fixed member.

19. The mechanism of claim 1 comprising a motor for moving said movable member relative to said fixed member.

20. The mechanism of claim 1 comprising a motor for said wind supply.

21. The mechanism of claim 1 comprising a motor for said bubble solution supply.

22. The mechanism of claim 1 further comprising a rotatable platform attached at said front of said shell comprising a plurality of spaced fixed members which can be sequentially aligned with said movable member, such that when said wind supply and said bubble solution supply are activated, to create a continuous series of bubbles is formed.

23. A bubble forming mechanism comprising a shell, said shell defining an internal space, a first member fixed to said shell having an opening; a second member moveable within said internal space of said shell comprising a protruding surface sized to be received within said first member opening; said second member being movable within said internal space of said shell relative to said first member between a position in which said second member is remote from said first member and a position wherein said second member is proximate said first member and said second member surface is within said fixed member opening, a bubble solution supply connected to supply bubble solution to said fixed member such that gravity causes the bubble solution to form a film within said first member opening and over said second member surface, when said first member is proximate said second member, after which said second member is moved to said remote position; a wind supply providing wind to said first member when second member is in said remote position, causing a bubble to be formed; and an actuator for controlling said position of said moveable member, for activating said bubble solution supply and for actuating said wind supply.

24. The mechanism of claim 23 wherein said second member surface has a shape of at least one of the following: conical, hemispherical, arcuate, pointed and any combination thereof.

25. The mechanism of claim 23 wherein when said second member is moved to said remote position, wind from said wind supply can move around said movable member to said first member.

26. The mechanism of claim 23 wherein when said second member is rotated away from said first member, wind from said wind supply can move to said first member.

* * * * *